US006640876B2

(12) United States Patent
Yajima et al.

(10) Patent No.: US 6,640,876 B2
(45) Date of Patent: Nov. 4, 2003

(54) METHOD AND APPARATUS FOR MANUFACTURING COPPER AND/OR COPPER ALLOY INGOT HAVING NO SHRINKAGE CAVITY AND HAVING SMOOTH SURFACE WITHOUT WRINKLES

(75) Inventors: Kenji Yajima, Kitamoto (JP); Norikazu Ishida, Osaka (JP); Yutaka Koshiba, Tokyo (JP); Keiji Nogami, Tokyo (JP); Akihiro Kakimoto, Tokyo (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 10/005,599

(22) Filed: Dec. 7, 2001

(65) Prior Publication Data

US 2003/0106664 A1 Jun. 12, 2003

(51) Int. Cl.[7] ..... B22D 27/04

(52) U.S. Cl. ..... 164/122.1; 164/122.2; 164/338.1

(58) Field of Search ..... 164/122.1, 122.2, 164/338.1

(56) References Cited

U.S. PATENT DOCUMENTS 4,867,224 A * 9/1989 Wakita et al. ..... 164/80
6,192,969 B1 * 2/2001 Bunn et al. ..... 164/122.1
6,287,364 B1 * 9/2001 Mizuta et al. ..... 75/646
6,354,360 B1 * 3/2002 Betz et al. ..... 164/122.1

FOREIGN PATENT DOCUMENTS

| | | |
|---|---|---|
| DE | 3316546 C1 | 5/1983 |
| DE | 3323896 A1 | 7/1983 |
| EP | 0141999 A1 | 10/1984 |
| JP | 11-310496 | 11/1999 |

* cited by examiner

*Primary Examiner*—Kuang Y. Lin
(74) *Attorney, Agent, or Firm*—Rader, Fishman & Grauer PLLC

(57) ABSTRACT

A method and apparatus for manufacturing copper and/or copper alloy ingots having no shrinkage cavities and having smooth surfaces without wrinkles are provided. The apparatus comprises a bottom-casting type melting furnace and a heating furnace for heating a mold in which the molten metal is cast. The method comprises the steps of melting the material of copper and/or copper alloy, and casting the molten copper and/or molten copper alloy into a cylindrical mold which is placed on a cooled pedestal provided at the bottom of the heating furnace and the side wall of which is heated by the heating furnace so as to form a temperature gradient increasing from the bottom to the top of the mold.

5 Claims, 5 Drawing Sheets

METHOD AND APPARATUS FOR MANUFACTURING COPPER AND/OR COPPER ALLOY INGOT HAVING NO SHRINKAGE CAVITY AND HAVING SMOOTH SURFACE WITHOUT WRINKLES

BACKGROUND OF THE INVENTION

1. Field of the Invention

The present invention relates to a method and apparatus for manufacturing copper and/or copper alloy ingots having no shrinkage cavity inside and having a smooth outside surface without wrinkles, and, in particular, relates to a method and apparatus for manufacturing high purity copper alloy ingots with a purity of more than 99.9999% by weight, having no shrinkage cavity and having a smooth surface without wrinkles.

2. Description of the Related Art

In general, copper and/or copper alloy ingots are manufactured by casting a molten copper and/or copper alloys into an ordinary mold or into a continuous casting mold.

However, a large shrinkage cavity is normally formed at the top portion of the ingot when the ingot is manufactured by casting in an ordinary mold and the shrinkage cavity must be removed by cutting off the shrinkage cavity from the ingot, which results in reducing the material yield. When the copper and/or copper alloy ingot are manufactured by casting the molten metal into a continuous casting mold, wrinkles are normally formed on the ingot surface and the wrinkles must be removed before subsequent processing. The shrinkage cavity and the wrinkles are liable to be formed in the high purity copper and/or copper alloy ingots with a purity of more than 99.9999% by weight. Therefore, a method and apparatus for manufacturing a high purity copper and/or copper alloy ingots which include no shrinkage cavity or wrinkles is desired.

SUMMARY OF THE INVENTION

In the course of studying a method and apparatus for manufacturing a high purity copper and/or copper alloy ingots having a purity of higher than 99.9999% by weight having no shrinkage cavity and having a smooth surface without wrinkles, the following knowledge was learned.

(a) The copper and/or copper alloy ingot with a purity of higher than 99.9999% by weight obtained by the following method include no shrinkage cavities and have smooth surfaces without wrinkles. The method comprises the step of casting the molten high purity copper or copper alloys (referred to as "metals" herein) into a mold, which is installed in a heating furnace such that a bottom surface of a mold is placed on a cooled pedestal in a heating furnace and the side wall of the mold is heated by a plurality of heating elements of the heating furnace so as to form a temperature gradient in the vertical direction of the mold increasing from the bottom towards the top.

(b) The temperature at the top portion of the side wall of the mold is preferably maintained at temperatures ranging from a temperature less than the melting point of copper to a temperature 150° C. below the melting point of copper.

The present invention has been accomplished based on the above knowledge, and the features of the present invention include the following.

(1) A manufacturing method for a copper and/or copper alloy ingot having no shrinkage cavities and having smooth surfaces without wrinkles comprising the step of casting the molten copper and/or copper alloys into a mold, which is heated, forming a temperature gradient in the vertical direction such that the temperature at the lower portion is lower and the temperature increases toward the upper portion.

In the above manufacturing method (1) for a copper and/or copper alloy ingot having no shrinkage cavities and having smooth surfaces without wrinkles, it is preferable to maintain the temperature at the upper portion of the mold within a temperature range between a temperature less than the melting point and a temperature 150° C. below the melting point. It is more preferable to maintain the temperature of the upper portion of the mold at a temperature 90° C. below the melting point. The reason for limiting the temperature of the upper portion within temperatures ranging from a temperature less than the melting point to a temperature 150° C. below the melting point is that, if the temperature at the upper portion of the mold is heated above the melting point, the top of the ingot will not be solidified so that a solid ingot is not obtained to the end, and if the temperature of the upper portion of the mold is lower then the temperature below 150° C. of the melting point, shrinkage cavities will be generated.

The features of present invention further include the following.

(2) In the manufacturing method for a copper and/or copper alloy ingots having no shrinkage cavities and having smooth surfaces without wrinkles comprising the step of casting the melt into a mold, which is placed on a cooled pedestal and which is heated so as to form a temperature gradient in the vertical direction in which the temperature of the lower portion is lower and the temperature increases toward the upper portion, wherein the temperature of the upper portion is maintained ranging from a temperature less than the melting point to a temperature 150° C. below the melting point of the copper and/or copper alloy.

DETAILED DESCRIPTION OF THE INVENTION

Figure 1:
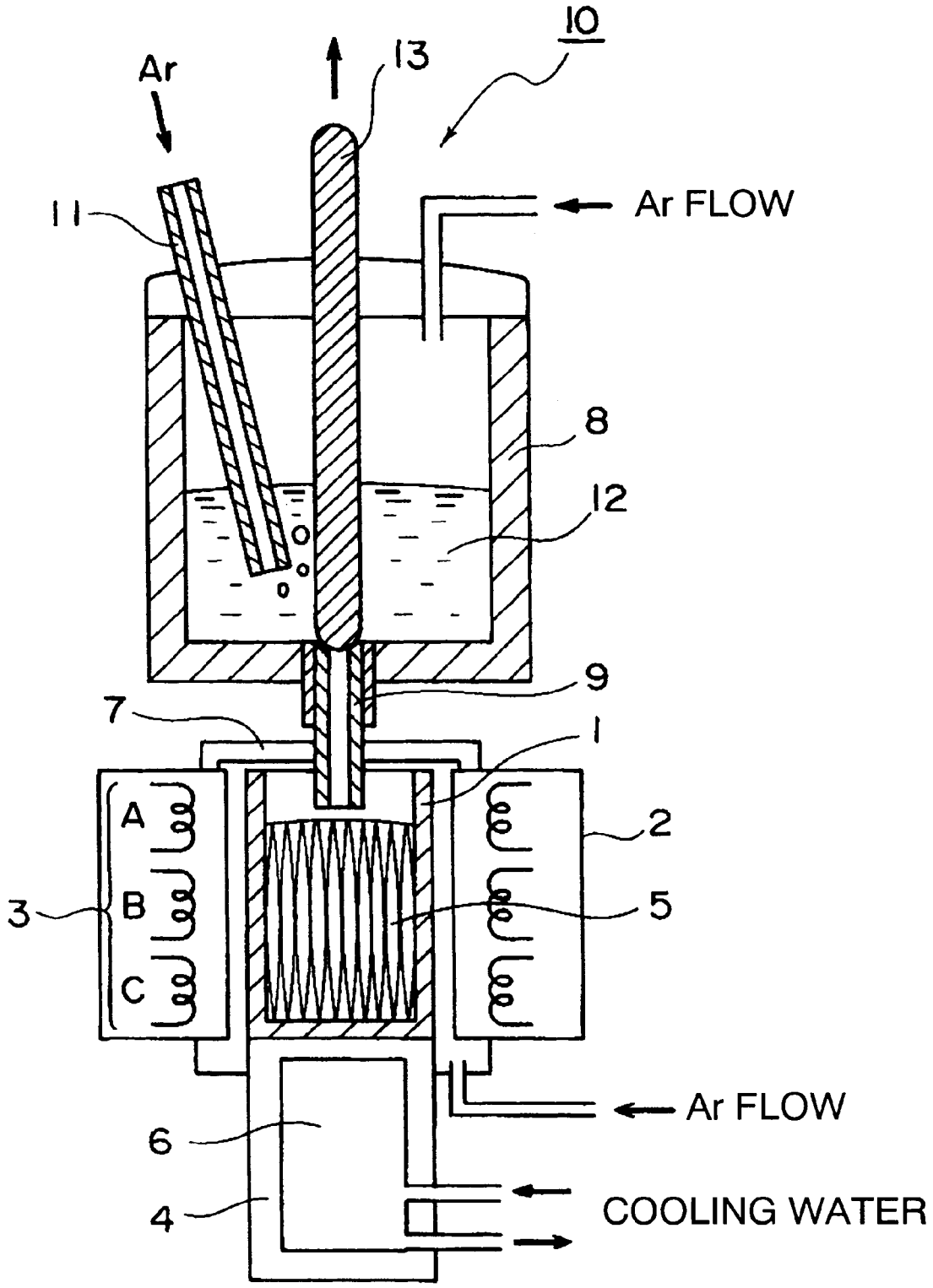
FIG. 1 is a cross-sectional view explaining an apparatus for executing a manufacturing method for producing high purity copper ingots without generating shrinkage cavities and wrinkles.

The manufacturing apparatus for the copper and/or copper alloy ingots having no shrinkage cavities and having smooth surfaces without wrinkles is explained below with reference to FIG. 1. FIG. 1 is a cross-sectional view explaining an apparatus for executing a manufacturing method for producing a high purity copper ingot having no shrinkage cavities and having smooth surfaces without wrinkles.

In FIG. 1, reference numeral 1 denotes a mold for mold forming the ingot, and the mold 1 is made of graphite. A heating furnace 2 is designed to provide a space in the middle for receiving the mold 1, and a plurality of heaters 3 are provided in the inside wall of the heating furnace 2. At the bottom of the heating furnace, a cooled pedestal 4 made of pure copper is provided, and water is supplied into the cavity 6 of the pedestal 4 for cooling the pedestal 4. When a molten metal is cast into the mold 1, the molten metal start to solidify from the bottom, and owing to the temperature gradient formed in the vertical direction of the mold 1, the molten metal is thereby finally solidified forming a unidirectional solidified structure. A lid 7 is provided at the open end of the mold, and the inner space of the heating furnace 2 and inside of the mold 1 is maintained in an inert gas atmosphere.

In order to form the temperature gradient in the vertical direction of the mold 1 from the lower portion held at a lower temperature to the higher portion held at a higher temperature at the top, the heater elements A, B, and C are provided in the heating furnace 2. The heating furnace is designed to control the upper portion to have the highest temperature by the heater element A and to control the lower portion of the mold at the lowest temperature by the heater element C. That is, when the temperatures of the mold heated by the heating elements A, B, C are represented by $T_A$, $T_B$, and $T_C$, respectively, these temperatures of the mold are controlled so as to be $T_A>T_B>T_C$, so that the temperature gradient is formed from the lower portion maintained at the lower temperature $T_C$ to the upper portion held at the higher temperature $T_A$ through the intermediate portion held at the intermediate temperature $T_B$.

The number of the heating elements are not limited to three, and it is desirable to provide a plurality of heating elements so as to be as numerous in order to thereby form a smooth temperature gradient in the vertical direction of the mold.

As described above, the mold 1 is placed in the heating furnace 2 and is heated by these heating elements while controlling the electric power supplied to each heating element so as to form a temperature gradient in the vertical direction of the mold. Subsequently, the molten metal (molten copper and/or copper aloy) 12 in the crucible 8 is injected into the mold 1 by pulling up the stopper 3. The molten metal 12 cast in the mold 1 is solidified from the bottom portion towards the upper portion and a metal ingot having a unidirectional solidified structure is obtained which includes no shrinkage cavities and has smooth surfaces without wrinkles. According to the present invention in contrast to the conventional continuous casting method, it is not necessary to solidify the molten metal from the upper portion to the lower portion while the mold is drawn out from the heating furnace. The effect of the present invention in that it is possible to manufacture a copper or copper alloy ingot provided with a unidirectional solidified structure having no shrinkage cavities and having smooth surfaces without wrinkles is presumably obtained by the as-cast solidification of the molten metal, in contrast to the conventional method in which molten metal is solidified in the oscillating state.

The molten copper and/or molten copper alloy 12 to be cast into the mold is obtained by melting in the bottom casting-type melting furnace 10, shown in FIG. 1. The bottom casting-type melting furnace 10 comprises the crucible 8 provided with a nozzle 9 at the bottom and a heating device (not shown). After the molten copper and/or the molten copper alloy is melted in the crucible placed in the bottom casting-type melting furnace, an inert gas is blown into the molten copper metal through a pipe 11 for the purpose of removing hydrogen. Subsequent to the removal of hydrogen, the molten copper metal is cast into the mold 1 through the pipe 9 by pulling up the stopper 13.

In order to manufacture high purity copper or copper alloy with a purity of 99.9999% by weight, which include no shrinkage cavities and has smooth surfaces without wrinkles, it is desirable to melt the high purity copper or copper alloy in the melting furnace 2 shown in FIG. 1 according to the present invention at temperatures ranging from 1150 to 1300° C. (preferably from 1200 to 1250° C.) to obtain the molten copper and/or molten copper alloy. Melting of the high purity copper and/or copper alloy is carried out in a high purity argon atmosphere, in a reducing atmosphere such as nitrogen containing 2–3% of CO gas, or in a vacuum. The dew point of the above-described high purity argon atmosphere or the reducing atmosphere is preferably lower than −5° C. The molten copper and/or the molten copper alloy obtained by the above-described melting and hydrogen removing process is cast into the mold so as to obtain the ingot by the unidirectional solidification.

When it is desired to manufacture different types of copper and copper alloy ingots other than the high purity copper and/or copper alloy with a purity of 99.9999% by weight according to the present invention, these other types of copper and/or copper alloy ingots can be manufactured by melting in the bottom casting type melting furnace and by casting into a mold heated in the heating furnace 2. However, these different types of copper or copper alloys must be melted in the melting furnace 10 at a melting temperature and a melting atmosphere selected so as to be compatible with the types of these copper and copper alloys, and cast into a mold, heated in the heating furnace 2, to have a temperature gradient with the highest temperature at the top of the mold determined according to the melting points of these copper metals.

EXAMPLES

Example 1

An electrolytic copper having a purity of higher than 99.9999% by weight was melted in a high purity Ar gas atmosphere having a dew point of less than −5° C. in a bottom casting-type melting furnace 10, shown in FIG. 1. Ar gas is blown into the molten copper metal obtained by the above melting process for removing hydrogen in the molten copper metal and the molten copper metal was maintained at 1250° C.

In the heating furnace 2, a mold 1 was placed to be mounted on a cooled pedestal 4, the bottom of which is cooled by water, and the inner space of the heating furnace 2 was maintained in a high purity Ar gas atmosphere having a dew point of less than −5° C. The side wall of the mold 1 was heated by three heater elements. The upper side wall of the mold was heated to a temperature of 1080° C. by the heater A, the intermediate side wall of the mold 1 was heated to a temperature of 950° C., and the lower side wall of the mold 1 was heated to a temperature of 800° C., in order to form a temperature gradient so that the temperature increases from the bottom portion towards the upper portion of the mold.

Figure 2A:
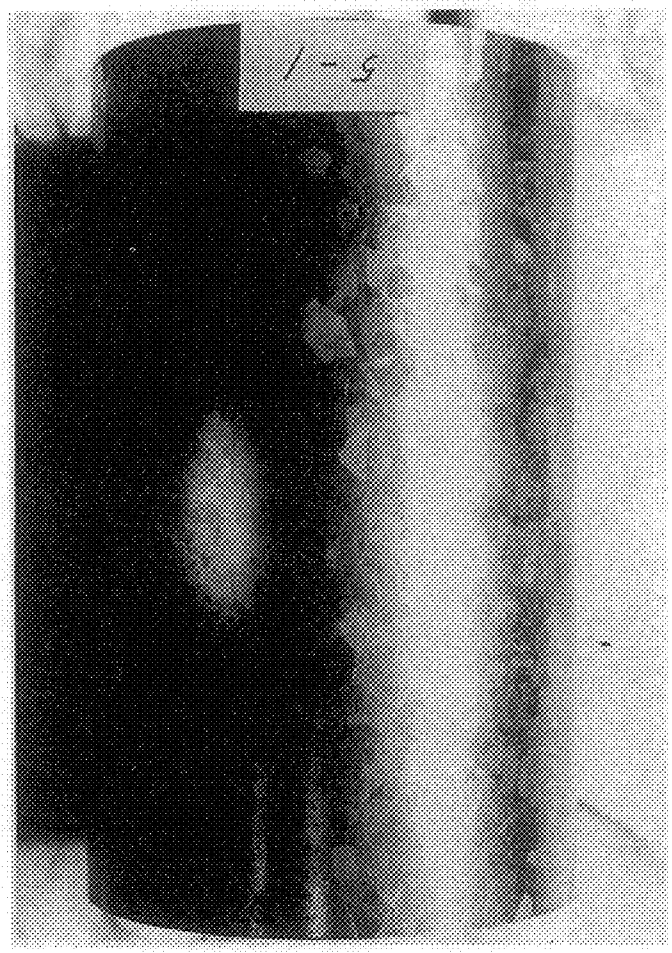
FIGS. 2A and 2B are photos showing a surface (FIG. 2A) and a cross-sectional view (FIG. 2B) of the high purity copper ingot manufactured according to the method of the present invention.
Figure 2B:
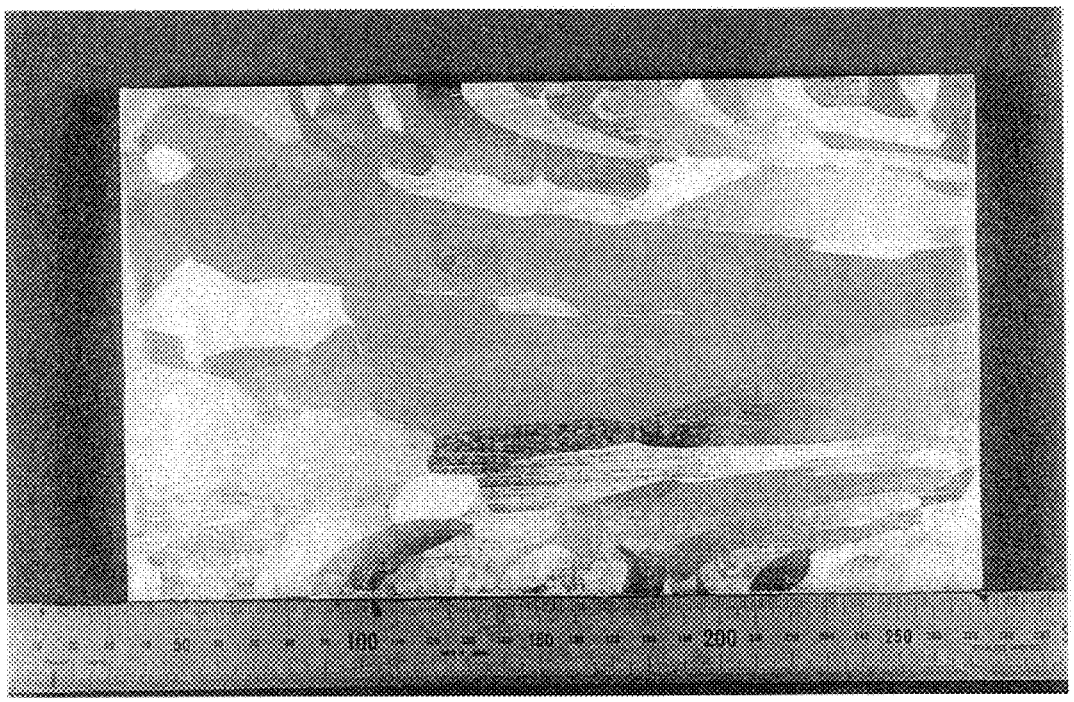

In the mold, in which the temperature gradient was formed such that the temperature increases from the lower portion toward the upper portion, the molten copper and/or copper alloy provided by the above-described method was cast, and the molten copper was solidified from the bottom to the upper portions, obtaining a high purity copper ingot having a diameter of 140 mm and a length of 250 mm, and the ingot had a unidirectional solidified structure. The surface of the ingot thus obtained is shown in FIG. 2A, and the cross-sectional structure of the ingot is shown in FIG. 2B. As shown in FIGS. 2A and 2B, the ingot manufactured according to the present invention did not have any blow-holes, pores, and shrinkage cavities, and the ingot had smooth surfaces and did not have any wrinkles.

Conventional Example 1

Figure 3A:
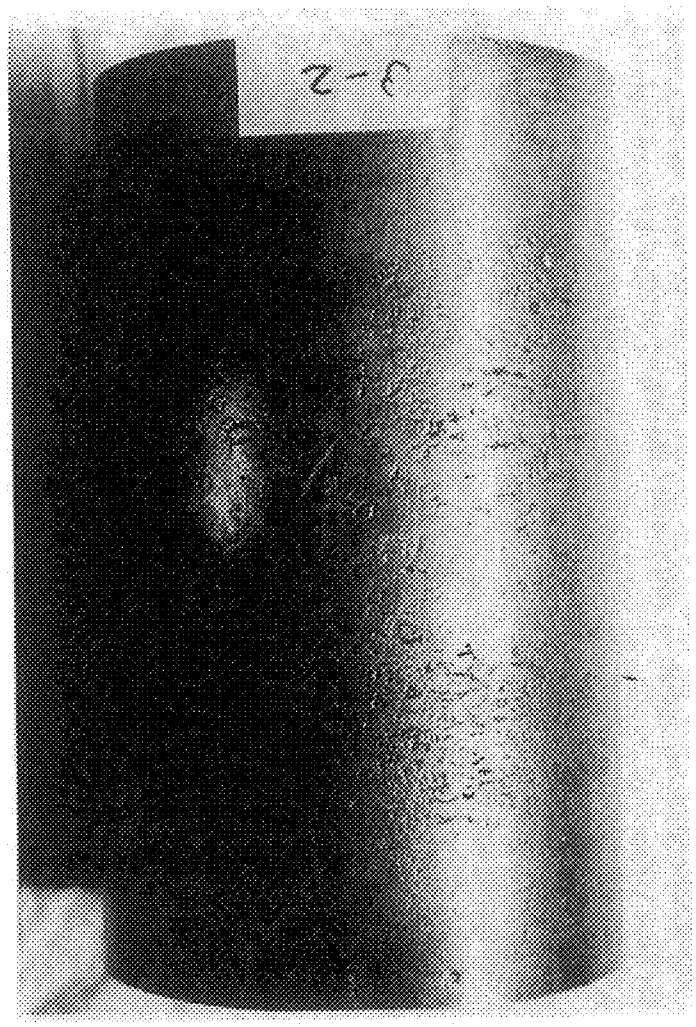
FIGS. 3A and 3B are photos showing a surface (FIG. 3B) and the cross-sectional view (FIG. 3B) of the high purity copper ingot manufactured by a conventional method.
Figure 3B:
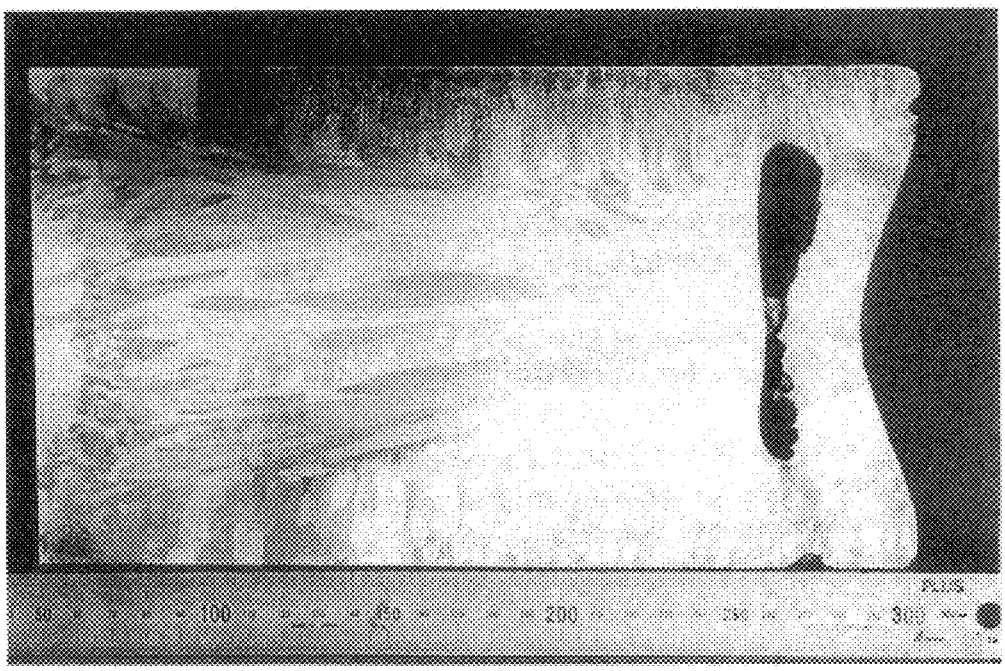

For the purposes of comparison, molten copper held at 1250° C., obtained by the same method as that of the Example 1 after removal of hydrogen, was cast into a mold heated to a homogeneous temperature of 900° C. placed in an Ar gas atmosphere. The morphology of the ingot is shown in FIG. 3A and the cross-sectional structure of the ingot is shown in FIG. 3B. As shown by these photos, the ingot formed by the conventional method has blow-holes, pores, and shrinkage cavities, and the surfaces of the ingot were covered with wrinkles.

According to the present invention, it is possible to manufacture copper and/or copper alloy ingots having no shrinkage cavities inside and having smooth outside surfaces without wrinkles.

What is claimed is:

1. A manufacturing method for a copper and/or copper alloy ingot having no shrinkage cavities and having smooth surfaces without wrinkles, comprising:

casting the molten copper and/or copper alloy into a mold;

placing the mold on a cooled pedestal so as to conductively cool a bottom of the mold and heating a side wall of the mold so as to form a temperature gradient, the temperature of which increases from the bottom toward the top of the mold.

2. A method for manufacturing a high purity copper or copper alloy ingot, comprising the steps of:

providing copper or copper alloy in a cavity of a crucible;

heating the crucible with the copper or the copper alloy contained in the crucible cavity to form a molten state of the copper or the copper alloy in an inert gas environment, a reducing environment or a vacuum;

injecting inert gas into the molten copper or molten copper alloy;

providing a mold having a bottom, a lid disposed at a top of the mold and a sidewall connected together to form a mold cavity therein;

transferring the inert-gas-injected molten copper or inert-gas-injected molten copper alloy into the mold cavity having an inert gas atmosphere with the sidewall surrounded by a furnace; and conductively cooling the bottom of the mold while simultaneously heating the sidewall of the mold in a manner to form a temperature gradient in the sidewall increasing from the bottom towards the top of the mold.

3. A method according to claim 2, wherein the sidewall includes a bottom portion, a top portion and an intermediate portion disposed between the bottom portion and a top portion and the furnace is operative to heat the bottom portion at a first temperature, the intermediate portion at a second temperature and the top portion at a third temperature, the first temperature being less than the second and third temperatures and the second temperature being less than the third temperature.

4. A method according to claim 3, wherein the first temperature is approximately 800° C., the second temperature is approximately 950° C. and the third temperature is approximately 1080° C.

5. A method according to claim 1, wherein the mold is placed on a cooled pedestal, the molten copper or copper alloy is cast into the mold placed in a cooled pedestal so as to conduct a fleet cooled the bottom of the mold and heating the sidewall without moving the mold upwardly or downwardly.

* * * * *